US009486081B2

(12) United States Patent
Sander et al.

(10) Patent No.: US 9,486,081 B2
(45) Date of Patent: Nov. 8, 2016

(54) ITEM OF SEATING FURNITURE, IN PARTICULAR OFFICE CHAIR

(75) Inventors: Armin Sander, Fürth (DE); Martin Potrykus, Bamberg (DE)

(73) Assignee: HAWORTH, INC., Holland, MI (US)

( * ) Notice: Subject to any disclaimer, the term of this patent is extended or adjusted under 35 U.S.C. 154(b) by 0 days.

(21) Appl. No.: 14/123,618

(22) PCT Filed: Apr. 30, 2012

(86) PCT No.: PCT/EP2012/001855

§ 371 (c)(1),
(2), (4) Date: Dec. 3, 2013

(87) PCT Pub. No.: WO2012/152399

PCT Pub. Date: Nov. 15, 2012

(65) Prior Publication Data

US 2014/0152064 A1 Jun. 5, 2014

(30) Foreign Application Priority Data

May 6, 2011 (DE) ..... 10 2011 100 708

(51) Int. Cl.
*A47C 7/02* (2006.01)
*A47C 7/44* (2006.01)
(Continued)

(52) U.S. Cl.
CPC . *A47C 7/44* (2013.01); *A47C 7/28* (2013.01); *A47C 7/405* (2013.01); *A47C 7/445* (2013.01); *A47C 7/448* (2013.01)

(58) Field of Classification Search
CPC ..... A47C 7/44; A47C 5/06; A47C 7/30; A47C 7/20; A47C 7/405; A47C 7/282; A47C 7/425; B60N 2/686; B60N 2/66
USPC ..... 297/285, 452.63, 452.52, 452.53, 297/452.54, 284.1, 284.3, 452.56, 284.4, 297/230.11
See application file for complete search history.

(56) References Cited

U.S. PATENT DOCUMENTS 3,353,869 A * 11/1967 Getz ..... A47C 5/125 267/111
3,476,169 A * 11/1969 Militano ..... 160/327
(Continued)

FOREIGN PATENT DOCUMENTS

CN 2168479 6/1994
CN 1331940 1/2002
(Continued)

OTHER PUBLICATIONS

International Search Report and Written Opinion, International Application PCT/EP2012/001855, dated Aug. 8, 2012.

*Primary Examiner* — David R Dunn
*Assistant Examiner* — Alexander Harrison
(74) *Attorney, Agent, or Firm* — Warner Norcross & Judd LLP

(57) ABSTRACT

The invention relates to an item of seating furniture (2), in particular an office chair, with a substantially curved supporting shell (14) which has two raised, curved, flexible curved arms (24) and a rigid central piece (16) arranged between said curved arms. Furthermore, the item of seating furniture (2) comprises a covering (30) which is clamped in the manner of a secant between the curved arms (24) of the supporting shell (14), wherein, when the covering (30) is loaded, at least one curved arm (24) is at least partially increasingly raised and/or is at least partially curved in the direction of the central piece (16).

18 Claims, 3 Drawing Sheets

Figure 1:
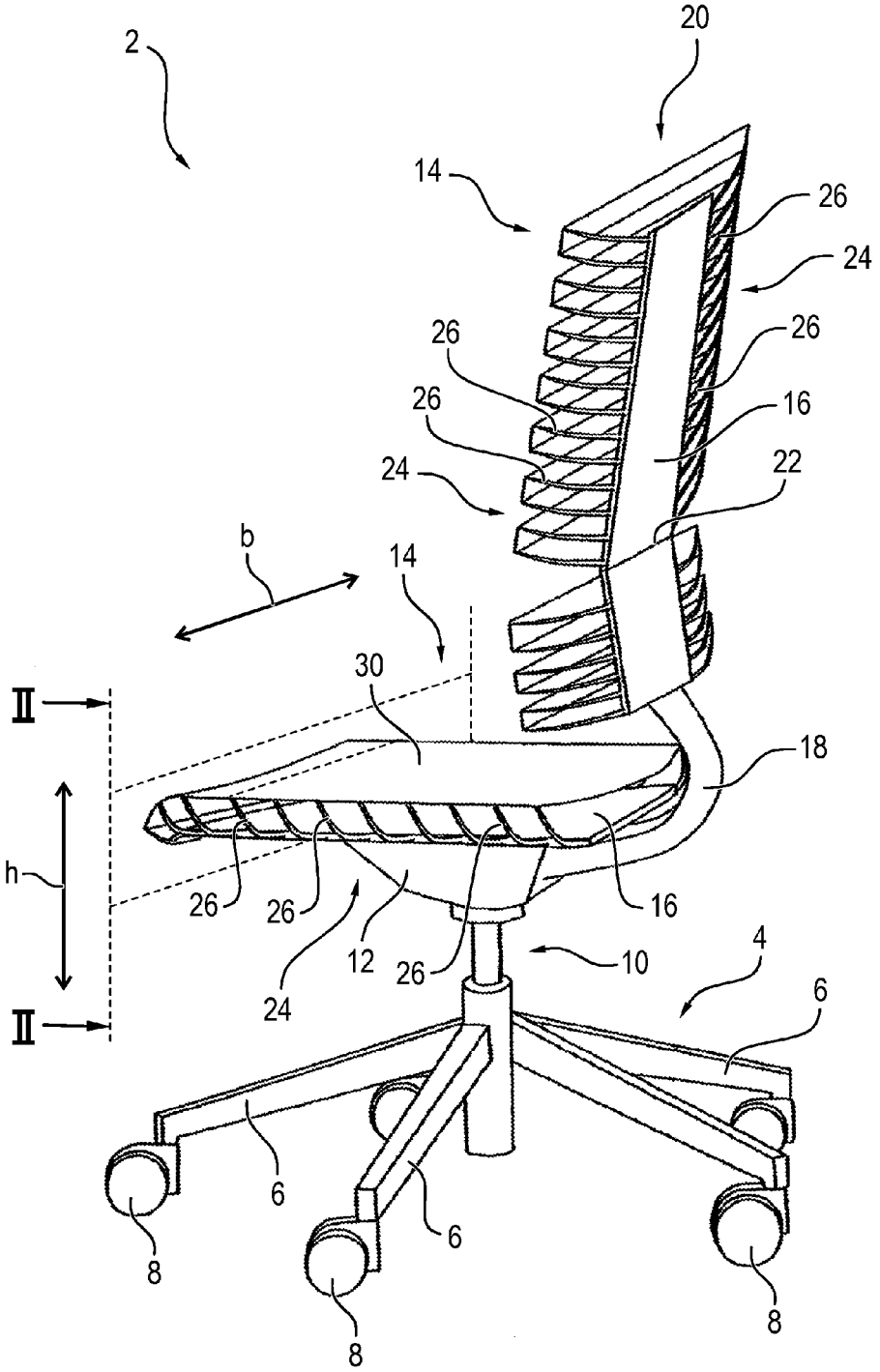

(51) Int. Cl.
*A47C 7/28* (2006.01)
*A47C 7/40* (2006.01)

(56) References Cited

U.S. PATENT DOCUMENTS

| | | | | |
|---|---|---|---|---|
| 4,049,315 | A | 9/1977 | Jacobson | |
| 4,408,800 | A | 10/1983 | Knapp | |
| 4,556,254 | A | 12/1985 | Roberts | |
| 4,658,807 | A * | 4/1987 | Swain | A47C 7/405 602/19 |
| 4,744,603 | A | 5/1988 | Knoblock | |
| 5,320,410 | A | 6/1994 | Faiks et al. | |
| 5,403,067 | A * | 4/1995 | Rajaratnam | 297/230.14 |
| 5,586,808 | A | 12/1996 | Oelke | |
| 5,645,321 | A * | 7/1997 | Seroldi | 297/452.63 |
| 5,826,937 | A | 10/1998 | Massara | |
| 5,951,109 | A | 9/1999 | Roslund et al. | |
| 5,988,757 | A | 11/1999 | Vishey et al. | |
| 6,572,190 | B2 | 6/2003 | Koepke et al. | |
| 6,910,736 | B2 | 6/2005 | White | |
| 6,971,717 | B1 * | 12/2005 | Rhodes | 297/230.1 |
| 7,032,971 | B2 * | 4/2006 | Williams | A47C 7/405 297/284.4 |
| 7,896,438 | B2 * | 3/2011 | Whelan | A47C 7/405 297/284.4 |
| 7,909,402 | B2 | 3/2011 | Chu et al. | |
| 8,590,978 | B2 * | 11/2013 | Jaranson | B60N 2/643 297/218.1 |
| 8,622,472 | B2 * | 1/2014 | Rajaratnam | 297/284.2 |
| 2001/0008955 | A1 | 7/2001 | Garth | |
| 2002/0130540 | A1 | 9/2002 | Rajasingham | |
| 2004/0007910 | A1 * | 1/2004 | Skelly | A47C 7/38 297/406 |
| 2004/0104610 | A1 * | 6/2004 | Jaskot et al. | 297/284.5 |
| 2004/0195882 | A1 * | 10/2004 | White | A47C 4/02 297/284.3 |
| 2004/0256899 | A1 * | 12/2004 | Moore | A61F 5/024 297/284.3 |
| 2006/0103214 | A1 * | 5/2006 | Andersson et al. | 297/378.13 |
| 2006/0181126 | A1 * | 8/2006 | Eysing | 297/284.1 |
| 2006/0255635 | A1 * | 11/2006 | Iijima | A47C 7/405 297/284.3 |
| 2007/0102987 | A1 * | 5/2007 | Chen | 297/452.56 |
| 2009/0102268 | A1 | 4/2009 | Schmitz et al. | |
| 2009/0261644 | A1 * | 10/2009 | Piretti | 297/344.12 |
| 2010/0187882 | A1 * | 7/2010 | Chen | 297/285 |
| 2012/0061988 | A1 | 3/2012 | Jaranson et al. | |
| 2012/0299350 | A1 | 11/2012 | Willingham | |
| 2013/0221724 | A1 | 8/2013 | Fowler | |
| 2014/0062154 | A1 | 3/2014 | Minino et al. | |
| 2014/0117738 | A1 * | 5/2014 | Takahashi et al. | 297/452.56 |
| 2014/0183914 | A1 * | 7/2014 | Cvek | 297/284.1 |

FOREIGN PATENT DOCUMENTS

| | | |
|---|---|---|
| CN | 1470420 | 1/2004 |
| CN | 1564666 | 1/2005 |
| CN | 1575142 | 2/2005 |
| CN | 101715310 | 5/2010 |
| DE | 102007002284 | 7/2008 |
| DE | 102008009509 | 8/2009 |
| DE | 102011100708 | 11/2012 |
| EP | 1232703 | 8/2002 |
| EP | 1693248 | 8/2006 |
| EP | 1785070 | 5/2007 |
| EP | 1911374 | 4/2008 |
| EP | 1946676 | 7/2008 |
| WO | 9212654 | 8/1992 |
| WO | 9848670 | 11/1998 |
| WO | 9848671 | 11/1998 |
| WO | 00/22961 | 4/2000 |
| WO | 03/063651 | 8/2003 |
| WO | 20120167940 | 12/2012 |

* cited by examiner

ITEM OF SEATING FURNITURE, IN PARTICULAR OFFICE CHAIR

The invention relates to an item of seating furniture, in particular an office chair, with the features of the preamble of Claim 1.

An office chair can substantially influence the dynamics of sitting. In the case of a rigid chair, only static sitting is possible whereas, in the case of an office chair, the mechanics and adjustment options thereof mean that dynamic sitting is required. A differentiation is made here between actively dynamic sitting, in which the seated individual can change the sitting position himself, and passively dynamic sitting, in which the change in position is predetermined by the chair.

Actively dynamic sitting, also referred to below as active or dynamic sitting, is conventionally made possible by means of a movable seat surface and/or backrest. Back pain, muscle tenseness, faulty posture and damaged intervertebral disks, which are caused by unrelaxed, static sitting, are therefore advantageously alleviated or even avoided, since the sitting position is continuously actively changed.

A conventional seat surface of an office chair is formed by a relatively hard seat shell on which a foam or cushion construction is customarily placed. An example of another possible variant embodiment of the seat surface is a seat frame in which a clamped net fabric forms the actual seat surface. However, both variant embodiments have a substantially rigid seat surface and are only suitable to a limited extent for active sitting.

DE 295 20 898 U1 and DE 297 03 793 U1 describe items of seating furniture for active sitting, in which the seat panel is mounted on a joint and is supported via spring elements. The seat panels can be tilted around the fixing point of the joint towards all sides counter to the resistance of the spring elements. However, this concept has the disadvantage that sitting requires permanent cooperation of the seated individual in order to avoid being inadvertently tipped off.

DE 10 2007 002 284 A1 and U.S. Pat. No. 5,713,632 disclose chairs with a seat and a seat mechanism which permits a lateral pivoting movement of the seat, wherein one side of the seat is movable independently of the other side of the seat during a lateral pivoting movement of the seat. Consequently, in the case of a chair of this type, it is not the entire seat surface as a rigid element which is tilted but rather only a half in each case. However, the two halves of the seat surface are only adaptable to a limited extent ergonomically to a particular seated individual, which has a disadvantageous effect on the sitting comfort.

The invention is based on the object of providing an item of seating furniture, in particular an office chair, which firstly permits active sitting and secondly permits adaptation to different sitting positions and various seated individuals without requiring adjustment.

This object is achieved according to the invention by the features of Claim 1. Advantageous developments and refinements are the subject matter of the dependent claims.

The item of seating furniture has a substantially curved supporting shell which comprises two curved arms. A central piece which is preferably of rigid and suitably flat design is arranged between the two curved arms. The two curved arms have a curvature and are therefore raised with respect to the central piece. In other words, one end of the respective curved arms, or at least a portion of each curved arm, is not located in the plane in which the central piece lies. The two curved arms are preferably raised in the same direction with respect to the central piece.

The supporting shell width is suitably determined essentially by means of the central piece width and one width in each case of the respective curved arms. In this case, the width of the central piece is expediently between one third and two thirds of the supporting shell, preferably between 40% and 60%. In particular, the two curved arms are symmetrical with respect to each other such that both widths of the curved arms are identical in size. The width of one of the two curved arms is, for example, between 20% and 30% of the width of the supporting shell.

There is a covering between the curved arms. The covering is joined to each of the two curved arms, expediently in the region of the respective ends or in the region which is not located in the plane of the central piece, and preferably spans the central piece in such a manner that—as seen in the cross section along the width of the supporting shell—the covering forms a secant of the supporting shell. When the covering is loaded, in particular when the covering is loaded in the direction of the central piece, or at least of a plane in which the central piece is located, the curvature of at least one of the curved arms changes. In other words, in the event of such a loading, at least one of the curved arms is raised to a comparatively greater extent and/or curved in the direction of the central piece. For example, in the case of a loading of the covering that takes place substantially centrally between the curved arms, the two curved arms are raised. By contrast, in particular in the event of a loading which takes place closer to one of the two curved arms, said curved arm is bent away from the central piece and the other of the two curved arms is bent towards the central piece.

Owing to the flexibility of the curved arms, a force is exerted which acts counter to the loading. Said force can be adjusted by influencing the rigidity of the curved arms. In this respect, a reduction in the rigidity acts in the manner of a change in the cushioning of a conventional item of seating furniture, namely the exchange for a softer cushioning. For example, during the production of the item of seating furniture, a hardness suitable for or desired by a user is selected, or the item of seating furniture is manufactured in such a manner that the user can change the rigidity during use.

By means of this item of seating furniture, active sitting is made possible owing to the supporting shell which adapts to the particular loading, since, during each such loading, a force acts counter to the user who has to compensate for such force. Furthermore, owing to the automatically changing force which results from the particular loading, adaptation or adjustment of the item of seating furniture to different users is not required.

The supporting shell may be an integral component of a backrest of the item of seating furniture. Expediently, however, the covering directly forms a seat surface. As an alternative thereto, a cushioning or the like is attached to the covering such that the covering indirectly forms the seat surface. The supporting shell absorbs the user's weight or passes on said weight. During correct use of the item of seating furniture, the central piece of the supporting shell is preferably located substantially in a parallel position to the supporting surface on which the item of seating furniture stands, and the curved arms are raised upwards. By means of changing the rigidity, it is also possible, for example, to vary the maximum supporting weight on a seat surface, which consists, for example, of the covering or is connected non-positively thereto.

In a preferred embodiment of the invention, the central piece is held in a positionally fixed manner at at least two spaced-apart points. This prevents tilting of the supporting shell. In order to achieve the maximum possible stability, the central piece is expediently fixed in the border region thereof and the two points expediently lie at a comparatively large distance from each other. The holding can take place positively, non-positively and/or with a cohesive material joint, for example by means of rivets, screws, adhesives or latching elements. In particular, the supporting shell is attached to a mechanism, wherein the fixing there takes place, for example by means of screws. The mechanism is configured to change the supporting shell in height and/or inclination and to lock said supporting shell in the particular position and/or to permit a predefined movement. For example, a backrest which is optional is connected to the mechanism and, in particular in the manner of a synchronous mechanism, executes the movements of the supporting shell along therewith.

For example, the cross section of the curved arms decreases from the central piece toward the respective ends. This has the result that the force which acts counter to a loading of the covering can be adjusted to the strength of the loading if the curved arms are composed only of a material which consequently has a constant modulus of elasticity. Therefore, by means of a suitable geometry of the curved arms, the counteracting force, for example in the case of a comparatively light loading, is superproportionally smaller than in the event of a comparatively heavy loading.

The curved arms are advantageously manufactured from a permanently elastic material, in particular spring steel. However, it would also be conceivable for the curved arms to be substantially composed of a resilient plastic, such as, in particular, glass fiber or carbon, or of a combination thereof. The central piece is expediently composed of the same material as the curved arms, and the supporting shell is expediently produced in one working step.

The curved arms expediently have a number of curved ribs arranged parallel to one another. It is thus possible to save on material, which results in a cost saving when producing the item of seating furniture and in a lower weight of the item of seating furniture. Furthermore, the force acting counter to the loading can be adjusted to the immediate region of the loading, which contributes to a more pleasant sensation for the user. Furthermore, by means of the use of differing curved ribs, the force can be restricted to different regions of the supporting shell or the strength of the latter can be adjusted differently in different regions. It is also possible by means of the ribs to impart a certain contour to the covering when the latter is not loaded. This takes place, for example, by the ribs being raised to a differing extent or differing in width from one another.

Two adjacent curved ribs at a time are advantageously connected to each other by means of a limb arc. In this case, the limb arc is located in particular in that end region of the curved ribs which is remote from the central piece. The limb arc expediently runs perpendicularly to the respective curved ribs.

The central piece is likewise divided, for example, into a number corresponding to the number of curved ribs of a curved arm. In particular, four curved ribs at a time are connected to one of the subsections arising from the division of the central piece. In this case, in particular, two of the curved ribs at a time are connected by means of in each case one of the limb arcs and therefore in each case lie on one side of the subsection. Said two resultantly formed pairs of curved ribs are preferably located on a mutually opposite side of the subsection.

This makes it possible for, for example, the supporting shell to be bent over the length thereof, and, accordingly, perpendicularly to the width thereof, in particular during use. For example, if the supporting shell is used as a backrest, it is possible for a user, via a bending of the supporting shell, to influence a "lordosis supporting function" of the backrest or to adapt the contour of the supporting shell to the user's back or to a desired posture.

In a suitable embodiment of the invention, the covering is essentially non-extendable, but is advantageously flexible. For example, the material of the covering is a plastic, and the covering is in particular a plastics plate or a net consisting of plastic. A cushion is optionally located on the covering in order to increase the sitting comfort.

However, in a first alternative of the invention, the covering is preferably a fabric. The latter has one or more tabs in particular in its border regions which are located in the vicinity of the curved arms. A portion of the respective curved arm, namely preferably the limb arcs, is located in each case in each of said tabs.

In an embodiment deviating therefrom, the covering is substantially formed from a number of straps running parallel to one another, in particular each of the straps being tensioned between the curved arms in such a manner that each of said straps essentially spans the central piece. Each strap is therefore clamped in the manner of a chord between the two curved arms. The straps are non-extendable here, or at least the extension of the straps is negligible, or at least comparatively low, on a conventional loading, i.e., for example, a user's weight. By this means, a possible exchange of a damaged covering is comparatively simple and cost-effective since only the particular damaged subsegment of the covering, rather than the entire covering, has to be exchanged.

A strap is advantageously tensioned in each case between two curved ribs, the two curved ribs being located essentially on opposite, in particular directly opposite, sides of the central piece. For example, the straps are fastened to the respective curved ribs by means of a number of screws or rivets or an adhesive. Owing to the division of the covering into mutually decoupled subsegments, namely the straps, an easier tilting and/or rocking movement of the user, as arises, for example, when the user leans forwards and backwards while seated, is made possible. It would also be conceivable for the straps each to be joined between two adjacent curved ribs of one of the curved arms in each case. The strap is preferably joined in each case between two curved ribs, in particular to the respective limb arc, on both sides of the central piece. For this purpose, in particular, the ends of the straps have tabs, by means of which the limb arcs are turned over between two curved ribs.

Figure 2A:
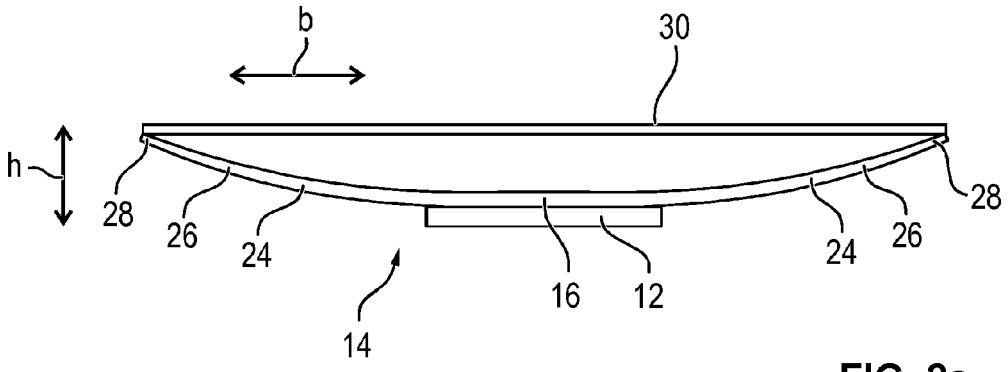
Figure 2B:
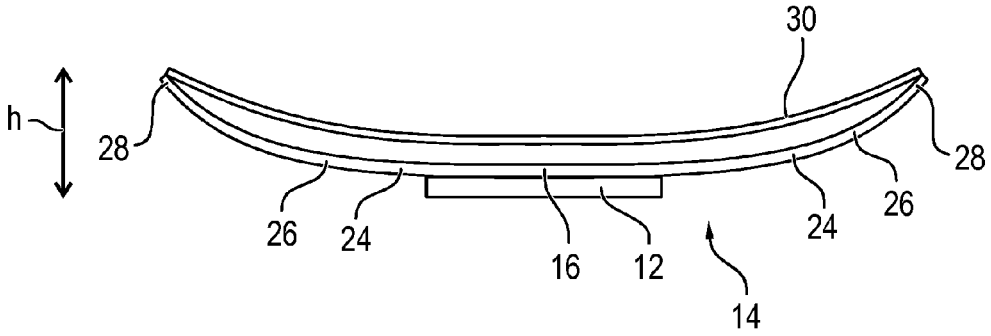
Figure 2C:
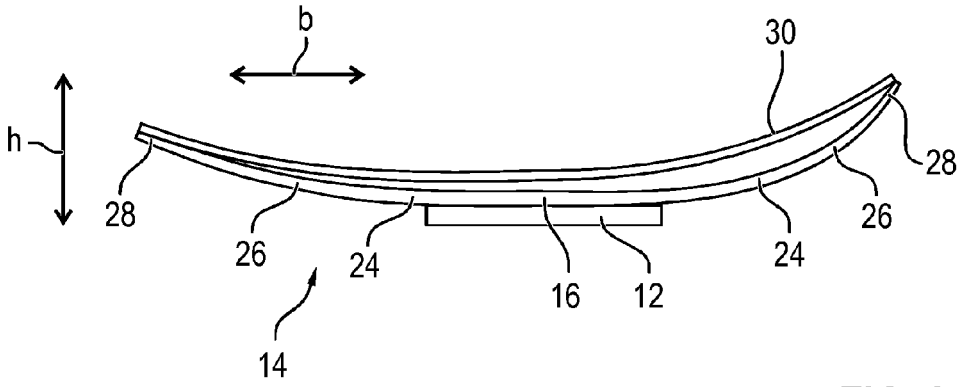
Figure 3:
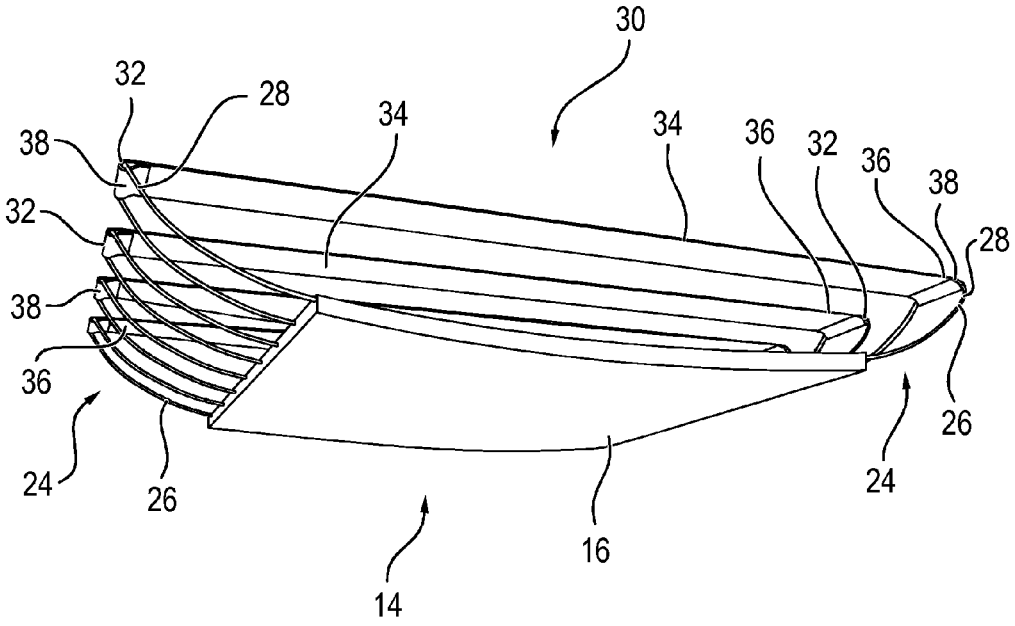
Figure 4:
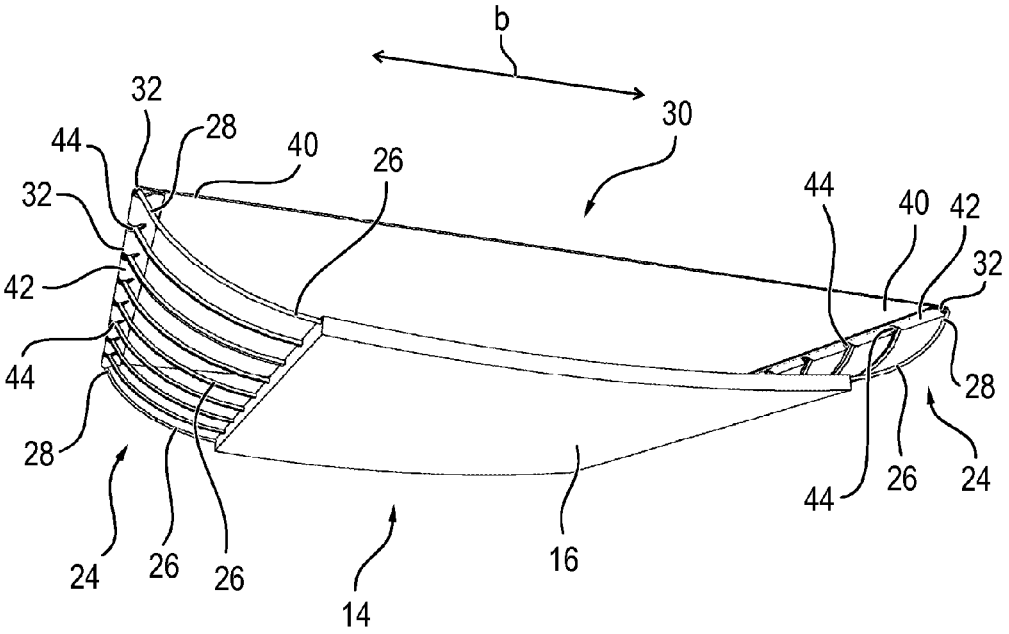

Exemplary embodiments of the invention are explained in more detail below with reference to a drawing, in which:

FIG. 1 shows perspectively an office chair with a supporting shell,

FIGS. 2*a*-2*c* show, in a sectional illustration, the supporting shell showing various loadings, FIG. 3 shows a first embodiment of a covering, and FIG. 4 shows a second embodiment of the covering.

Mutually corresponding parts are provided with the same reference numbers in all of the figures.

FIG. 1 illustrates an item of seating furniture 2, wherein the item of seating furniture 2 is an office chair. The office chair comprises a "foot cross" 4 with five arms 6, to the respective ends of which respective chair castors 8 are pivotably fastened. In the center of the foot cross 4 is a height adjustment mechanism 10 which connects the foot cross 4 to a baseplate 12. By means of the height adjustment mechanism 10, the distance between the baseplate 12 and the foot cross 4 can be changed along a direction h. The distance here can be adjusted in an infinitely variable manner within a certain range and can be fixed. In order to stabilize the baseplate 12 during the adjustment, the mechanism 10 comprises a gas-filled compression spring which prevents abrupt dropping movements of the baseplate 12. The gas-filled compression spring also permits dipping of the base surface 12 if the baseplate 12 is suddenly loaded, such as, for example, when a user sits down on the item of seating furniture 2.

A curved supporting shell 14 having a rigid central piece 16 is fixed on the baseplate 12. The central piece 16 rests virtually over the entire width thereof on the baseplate 12 and is, in particular, adhesively bonded over a large area thereto, but may also be welded thereto. The width of the central piece 16 is parallel here to a direction b. The baseplate 12 has a tilting joint by means of which the supporting shell 14 can be tilted, wherein the axis of rotation is parallel to the direction b. A bearing is also part of the baseplate 12, by means of which bearing the supporting shell 14 can be rotated about an axis, the axis being parallel to the direction h. Levers which can be used to control the mechanism 10 and also the rotational movements by means of the bearing and the tilting joint are attached to the baseplate 12.

The baseplate 12 is adjoined by a neck 18 to which a backrest 20 is fastened. The backrest 20 comprises a further supporting shell 14, the central piece 16 of which is screwed to the neck 18, for example at at least two points. Said central piece 16 has a joint 22 which is designed, for example, as a plastic joint. The joint 22 serves here as a "lordosis support".

In contrast to the office chair depicted, in a further embodiment of the item of seating furniture 2 the two supporting shells 14 can be covered and a cushioning can also be additionally attached in each case to said supporting shells.

FIGS. 2*a* to 2*c* show, in simplified sectional illustrations, the first supporting shell 14 according to FIG. 1. The supporting shell 14 is fixed on the baseplate 12 by means of the central piece 16. The central piece 16 is adjoined in direction b by respective curved arms 24, wherein the curved arms 24 are divided into individual curved ribs 26. The curved arms taper towards the respective ends 28 thereof, which ends are at the greatest distance from the central piece 16. The curved arms 24 are raised at the ends 28 thereof. In other words, the ends 28 are at a distance from the central piece 16 in the direction h. The supporting shell 14 is manufactured, for example, integrally from spring steel. A covering 30 which spans the central piece 16 is joined to the ends 28. The covering 30 is composed of a material which is non-extendable, or is at least comparatively difficult to extend. The covering 30 serves as the seat region of the item of seating furniture 2.

FIG. 2*b* illustrates a loading of the covering 30 downwards, i.e. a loading towards the central piece 16 along the direction h. The loading takes place here centrally in the direction b. The covering 30 bulges downwards. Owing to the lack of extensibility of the covering 30, the flexible curved arms 24, and specifically the ends 28 thereof, are curved upwards and towards the central piece 16. Owing to the elasticity of the curved arms 24, a force acts counter to the bending of said curved arms and therefore counter to the loading. If the loading originates from a user who has sat down, a resilient effect arises, since the loading is customarily not constant because the user generally moves at least sometimes. This is perceived to be pleasant by the user.

In comparison to FIG. 2*b*, FIG. 2*c* illustrates a loading which no longer takes place centrally along the direction b but rather, for example, further to the left. The left curved arm 24 is not raised but rather is bent downwards if the loading is comparatively large or takes place comparatively far to the left. So that such a bending does not take place normally or only comparatively rarely, the rigidity of the curved arms 24 is comparatively great and is matched to the user's weight. By contrast, the right curved arm 24 is raised to a comparatively great extent. Owing to this asymmetry of the bending of the curved arms 24, the covering 30 is likewise asymmetrically curved inwards such that a type of slope is formed by means of the covering 30. Should the loading on one side be inadvertent, the user is induced automatically again to change the sitting position thereof such that the loading takes place substantially centrally between the curved arms 24, as illustrated in FIG. 2*b*. It is likewise possible for the user to adopt a sitting position with an asymmetric loading of the covering 30, if the user finds this pleasant. The user does not have to make any adjustment to the item of seating furniture 2 for this purpose. Different users having different sitting preferences can therefore use the item of seating furniture 2 without an adjustment of the item of seating furniture 2 having to be changed between each use.

Owing to the reaction of the curved arms 24, the user of the item of seating furniture 2 finds the use, i.e. sitting, to be pleasant since the user does not feel any sharp edges or hard resistances of the supporting shell 14. On the contrary, owing to the force applied by the curved arms 24, the user is encouraged to continually at least partially change his sitting position. This counteracts fatigue of the user's muscular system. Furthermore, the muscles are easily stressed during sitting, and therefore the muscular system is built up, but at least is not degraded during sitting. Therefore, the user does not develop any back pain or other pain.

FIG. 3 shows a first embodiment of the covering 30, this embodiment being used in the backrest 20 illustrated in FIG. 1. Use in the supporting shell 14 which forms the seat region in FIG. 1 would likewise also be conceivable. In comparison to the supporting shells 14 illustrated in FIGS. 2*a*-2*c*, in the case of the supporting shell 14 shown in FIG. 3 the central piece 16 and the curved arms 24 or the curved ribs 26 are not integral. On the contrary, the central piece 16 is composed of a plastic into which curved ribs 26 which are bent from spring steel are inserted and fixed there. It is also conceivable for the spring steel of which the curved ribs 26 are composed to be guided through the plastic, and therefore for the central piece 16 to be composed of a plastic reinforced with spring steel.

Two of the curved ribs 26 located on the same side of the central piece 16 are connected at a time to each other in the end regions 28 thereof by means of a limb arc 32. The limb arc 32 is composed in particular of the same material as the curved ribs 26 which the limb arc connects. The two interconnected curved ribs 26 and the limb arc 32 are expediently formed integrally, i.e. are bent from spring steel wire, the diameter of the wire being such that the diameter of the curved ribs 26 is smaller in the region of the ends 28 than in the region which is adjacent to the central piece 16.

The covering 30 is formed from a number of straps 34, each of the straps 34 spanning the central piece 16. The straps 34 are manufactured from a non-extendable material, for example from a prestretched polyester strip material or leather. Each of the straps 34 has a tab 38 at each of the two longitudinal ends 36 thereof. The tab 38 is formed from the strap 34 itself which, for this purpose, is turned over onto itself on the end side. The end of the strap 34 is connected to the strap itself, for example, by means of seams and/or adhesive bonding. One of the limb arcs 32 is located within each of the tabs 38. The straps 34 are tensioned between the curved ribs 26 in such a manner that the straps 34 run on the curved ribs 26 substantially parallel to a projection thereof.

FIG. 4 illustrates a second embodiment of a covering 30. This embodiment corresponds, for example, to the covering 30 which is attached to the supporting shell 14 which forms the seat region in FIG. 1. The construction of the supporting shell 14 substantially corresponds to that of the supporting shell 14 shown in FIG. 3.

In this example, the covering 30 is a fabric which is manufactured in particular from plastic and is non-extendable. At the curved-arm ends 40 thereof, the fabric has respective tabs 42 with a number of holes 44. The limb arcs 32 of the curved arms 24 are located within the tabs 42. The curved ribs 26 which are connected to the limb arcs 32 are guided through the holes 44 such that the fabric is tensioned over the central piece 16. During production, the curved ribs 26 are first of all guided through the holes 44 in the fabric and, in a subsequent method step, the tabs 42 are formed by the fabric being turned over onto itself in the region of the ends 40 thereof. The turned-over region is fastened to the fabric, for example, by means of adhesive or by seams. In particular, the holes 44 and the limb arcs 32 form the boundary of the covering 32 and of the supporting shell 14, respectively, in the direction b.

LIST OF DESIGNATIONS

2 Item of seating furniture
4 Foot cross
6 Arm
8 Chair castor
10 Height adjustment mechanism
12 Baseplate
14 Supporting shell
16 Central piece
18 Neck
20 Backrest
22 Joint
24 Curved arm
26 Curved rib
28 End
30 Covering
32 Limb arc
34 Strap
36 Longitudinal end
38 Tab
40 Curved-arm end
42 Tab
44 Hole
h Direction
b Direction

The invention claimed is:

1. Item of seating furniture (2), in particular office chair, with a covering (30) and with a substantially curved supporting shell (14) which comprises:

a first raised curved arm (24) and a second raised curved arm (24), separate and spaced apart from the first raised curved arm (24), each of which have a curvature, the first and second raised curved arms each being divided into a number of individual curved ribs (26) that are curved along a length of the ribs (26) toward rib ends (28), at least two of the ribs (26) of each of the raised curved arms (24) having rib ends (28) that are separate and spaced apart from one another, and a substantially rigid central piece (16) arranged between said first and second curved arms such that the first curved arm extends from a first side of the rigid central piece (16) and the second curved arm extends from a second side of the rigid central piece (16), opposite the first side, wherein the curved arms (24) are flexible, and wherein the at least two of the ribs (26) of the first raised curved arm (24) have rib ends (28) that are free and can flex independently of one another and the at least two of the ribs (26) of the second raised curved arm (24) have rib ends (28) that are free and can flex independently of one another, wherein the rib ends (28) of the first raised curved arm (24) and the rib ends (28) of the second raised curved arm (24) are connected to the covering (30) and are free to individually flex with the covering (30), and wherein the covering is clamped in the manner of a secant between the two curved arms (24) of the supporting shell (14) in such a manner that, when the covering (30) is loaded, at least one of the curved arms (24) bends such that the curvature of at least one of the curved arms (24) changes.

2. Item of seating furniture (2) according to claim 1, wherein the covering (30) extends between the respective rib ends (28) of the first and second raised curved arms (24) such that the covering (30) spans the complete distance between the rib ends (28) of the curved ribs (26) on one side of the central piece (16) and the rib ends (28) of the curved ribs (26) on the other side of the central piece (16).

3. Item of seating furniture (2) according to claim 2, wherein the covering (30) indirectly or directly forms a backrest.

4. Item of seating furniture (2) according to claim 3, wherein the central piece (16) is held in a positionally fixed manner at at least two spaced-apart points.

5. Item of seating furniture (2) according to claim 4, wherein the cross section of the first and second raised curved arms (24) tapers from the central piece (16) to the respective rib ends (28) of said curved arms.

6. Item of seating furniture (2) according to claim 5, wherein the first and second raised curved arms (24) are manufactured from a permanently elastic material, in particular spring steel.

7. Item of seating furniture (2) according to claim 1, wherein the number of curved ribs (26) are arranged parallel to one another.

8. Item of seating furniture (2) according to claim 7, wherein the rib ends (28) of two mutually adjacent curved ribs (26) at a time are connected to each other by means of a limb arc (32).

9. Item of seating furniture (2) according to claim 7, wherein the covering (30) is a fabric which, at the curved-arm ends (40) thereof, has tabs (42) within which the corresponding first and second raised curved arm (24) is located.

10. Item of seating furniture (2) according to claim 8, wherein the covering (30) is essentially formed from a number of extension-free straps (34) which run parallel to one another, each of the straps (34) being clamped in the manner of a chord between the first and second raised curved arms (24).

11. A backrest for an item of seating furniture, in particular an office chair, comprising:

a substantially rigid central piece (16) having a first side and a second side opposite the first side;

a first curved arm (24) extending from the first side of the substantially rigid central piece (16) and a second curved arm (24), separate and spaced apart from the first curved arm (24), extending from the second side of the substantially rigid central piece (16), the first curved arm (24) formed from a number of first individual curved flexible ribs (26) that are curved along a length of the ribs (26) toward rib ends (28) that are spaced apart and independently flexible with respect to one another, and the second curved arm (24) formed from a number of second individual curved flexible ribs (26) that are curved along a length of the ribs (26) toward rib ends (28) that are spaced apart and independently flexible with respect to one another; and a covering (30) that is connected to the respective rib ends (28) of the first curved arm (24) and the second curved arm (24) such that the covering (30) spans the complete distance between the rib ends (28) of the first individual curved ribs (26) on one side of the central piece (16) and the rib ends (28) of the second individual curved ribs (26) on the other side of the central piece (16) in such a manner that, when the covering (30) is loaded, at least one of the individual curved ribs (26) bends such that the curvature of at least one of the individual curved ribs (26) of the first curved arm (24), the second curved arm (24), or both changes, wherein the rib ends (28) of the first curved arm (24) are connected to the rib ends (28) of the second curved arm (24) only via the cover (30), wherein the curvature of the first curved arm (24) can change asymmetrically with respect to the curvature of the second curved arm (24) when the covering (30) is loaded asymmetrically.

12. The backrest of claim 11 wherein each of the first individual curved flexible ribs (26) are substantially spaced apart from one another such that they can flex independently from one another, and wherein each of the second individual curved flexible ribs (26) are substantially spaced apart from one another such that they can flex independently from one another.

13. The backrest of claim 12 wherein the rib ends (28) of the first and second individual curved ribs (26) are positioned within a portion of the cover (30) such that the cover (30) extends beyond the respective rib ends (28).

14. A backrest for an item of seating furniture, in particular an office chair, comprising:

a substantially rigid backrest piece having a backrest piece first side and a backrest piece second side opposite the backrest piece first side;

a flexible cover having a cover first side and a cover second side;

a first curved arm formed from a number of first curved flexible ribs extending between the backrest piece first side and the cover first side, the first curved flexible ribs curved along a length thereof between the backrest piece first side and the cover first side, the first curved arm having a free end that is connected to the cover first side; and a second curved arm formed from a number of second curved flexible ribs extending between the backrest piece second side and the cover second side, the second curved flexible ribs curved along a length thereof between the backrest piece second side and the cover second side, the second curved arm having a free end that is connected to the cover second side, the second curved arm separate and spaced apart from the first curved arm on opposite sides of the backrest piece, wherein the free end of the first curved arm is connected to the free end of the second curved arm only via the covering such that the number of first curved flexible ribs are independently flexible with respect to the number of second curved flexible ribs, and wherein the first curved arm and the second curved arm support the cover on the backrest piece and wherein when the cover is loaded, at least one of the number of first or second curved flexible ribs bends such that a curvature of at least one of the number of first or second curved flexible ribs changes.

15. The backrest for an item of seating furniture of claim 14, wherein the first and second curved flexible ribs each include ends, and wherein the cover extends between the respective ends of the first and second curved flexible ribs such that the cover spans the complete distance between the ends of the first curved flexible ribs on one side of the backrest piece and the ends of the second curved flexible ribs on the other side of the backrest piece.

16. The backrest for an item of seating furniture of claim 14, wherein the cover indirectly or directly forms a backrest.

17. The backrest for an item of seating furniture of claim 14, wherein the number of first curved flexible ribs are arranged parallel to one another and the number of second curved flexible ribs are arranged parallel to one another.

18. The backrest for an item of seating furniture of claim 14, wherein the first and second curved flexible ribs each include ends, and wherein the ends of at least two mutually adjacent curved flexible ribs of each of the first and second curved arms are connected to each other.

* * * * *